US006052848A

United States Patent [19]

Kelly

[11] Patent Number: 6,052,848

[45] Date of Patent: Apr. 25, 2000

[54] BODY SUPPORT PILLOW

[76] Inventor: Jean Kelly, 924 Washington Ave., Oshkosh, Wis. 54901

[21] Appl. No.: 09/124,818

[22] Filed: Jul. 29, 1998

[51] Int. Cl.[7] ..... A47C 20/00; A47C 20/04

[52] U.S. Cl. ..... 5/632; 5/640; 5/645; 5/630

[58] Field of Search ..... 5/632, 638, 640, 5/922, 930, 655, 645, 630, 652; 441/123, 113, 117

[56] References Cited

U.S. PATENT DOCUMENTS

| | | | |
|---|---|---|---|
| D. 124,296 | 12/1940 | Thompson . | |
| 556,088 | 3/1896 | Daly . | |
| 682,871 | 9/1901 | Hogan et al. . | |
| 2,795,802 | 6/1957 | Myers | 5/632 |
| 3,299,451 | 1/1967 | Trogdon | 5/640 |
| 3,574,397 | 4/1971 | Norris . | |
| 3,755,828 | 9/1973 | Sattler . | |
| 3,757,364 | 9/1973 | Downing . | |
| 3,883,906 | 5/1975 | Sumpter . | |
| 3,988,795 | 11/1976 | Robertson | 441/123 |
| 4,173,048 | 11/1979 | Varaney | 5/632 |
| 4,197,604 | 4/1980 | Nakamura . | |
| 4,236,264 | 12/1980 | Britzman . | |
| 4,393,530 | 7/1983 | Stark . | |
| 5,231,720 | 8/1993 | Benoff . | |
| 5,313,678 | 5/1994 | Redewill . | |
| 5,339,472 | 8/1994 | Yin . | |
| 5,344,437 | 9/1994 | Pistay . | |
| 5,457,832 | 10/1995 | Tatum . | |
| 5,481,771 | 1/1996 | Burk, IV . | |
| 5,519,906 | 5/1996 | Fanto-Chan . | |
| 5,638,564 | 6/1997 | Greenawalt et al. . | |
| 5,661,861 | 9/1997 | Matthews | 5/632 X |
| 5,661,862 | 9/1997 | Ryndak . | |
| 5,664,272 | 9/1997 | Douglas, Sr. . | |
| 5,826,287 | 10/1998 | Tandrup | 5/655 |
| 5,836,024 | 11/1998 | Uglehus et al. | 5/630 X |

FOREIGN PATENT DOCUMENTS

| | | |
|---|---|---|
| 838455 | 6/1960 | United Kingdom . |
| 2198341 | 6/1988 | United Kingdom . |

*Primary Examiner*—Terry Lee Melius
*Assistant Examiner*—Rodrigo J. Morales
*Attorney, Agent, or Firm*—Bullwinkel Partners, Ltd.

[57] ABSTRACT

A body support pillow stuffed with a resilient deformable filler having a U-shaped central section and depending legs, the pillow having a center opening equal to the body width of a user. In a first embodiment the pillow's total length is substantially equal to the height of a user, and the legs are selectively foldable over one another to create a double thickness for additional support under the user's knees, with a detachable body-encircling strap securing the pillow about the user. In a second embodiment for use in a chair the legs support the arms of a user, and may be raised by rotating them 90 degrees. In a third embodiment, the interior of the pillow is divided by sewn-in baffles into three separately stuffable compartments all accessible through a single continuous zipper opening.

5 Claims, 2 Drawing Sheets

FIG. 1
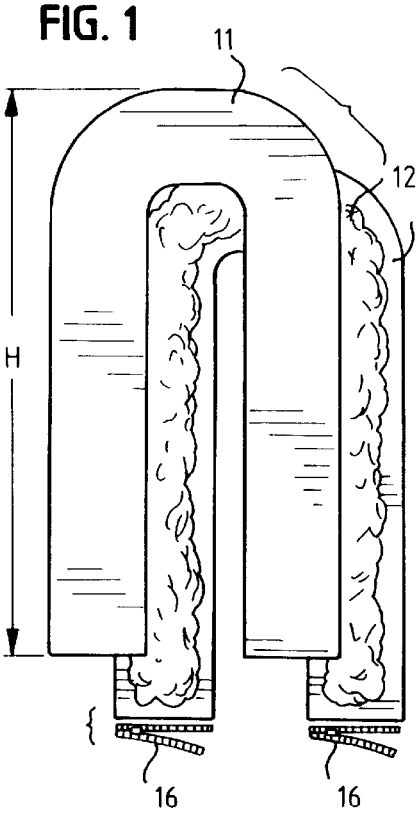
FIG. 2
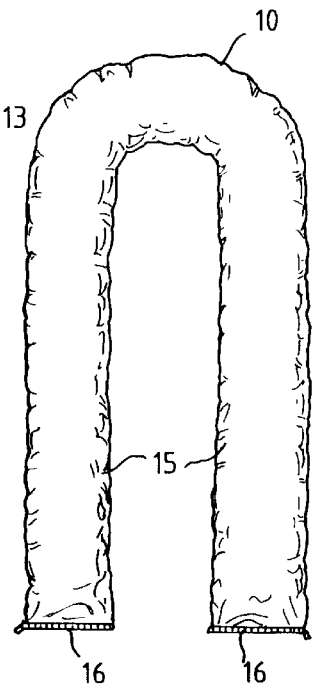
FIG. 3
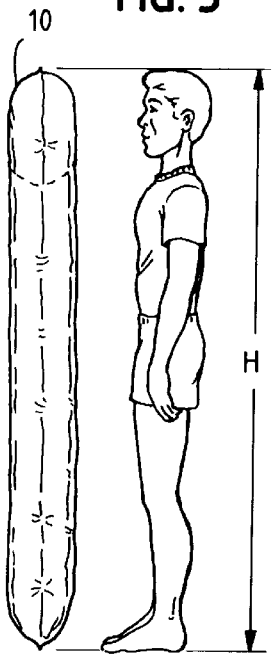
FIG. 4
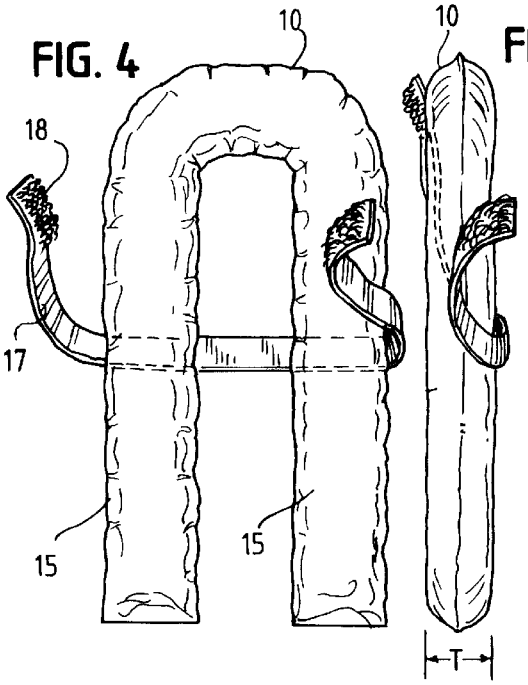
FIG. 5
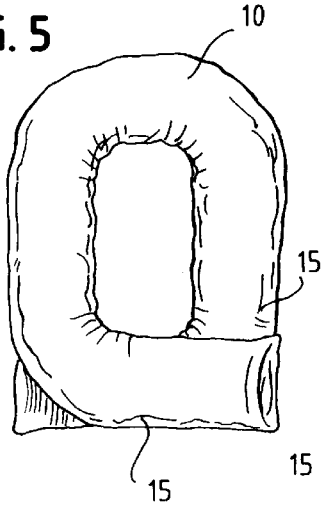
FIG. 6
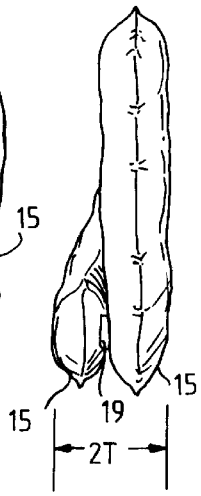
FIG. 7

BODY SUPPORT PILLOW

BACKGROUND OF THE INVENTION

1. Field of the Invention

This invention relates to a support pillow to give comfort to those individuals who have medical conditions which hinder their ability to support their body normally by their muscle-skeletal system. By providing a stable cushioned support, proper joint alignment can be maintained which will reduce stress on muscles, ligaments and joints.

Many categories of medical patients require special support to provide comfort. Pregnant women frequently develop sleep problems due to back pain, cramps and weight gain. Patients with fibromyalgia experience pain in the cervical and thoracic aspects of their backs. Geriatric patients, and patients who have suffered a stroke, often require additional side support to allow them to sit comfortably in a chair. Patients with painful bone and muscle conditions, such as caused by cancer, often need joint and muscle support for their entire body.

As a registered nurse, I have worked in health care facilities in many capacities, including orthopedics, long term geriatrics, arthritis, fibromyalgia and cancer, particularly bone cancer. I personally suffer from fibromyalgia which is a condition that affects fibrous and muscle tissues so that any long term period of inactivity causes muscles to tighten and become stiff and painful. Sleep for a fibromyalgia patient is difficult due to waking up with stiffness of the joints.

2. Description of the Prior Art

Prior art pillows adapted to serve the medical purposes described above include cervical neck pillows which may attach in the front to form a doughnut-shaped support, and lumbar pillows for limited support of the lower back.

Another prior art product which has been sold through catalogs is an elongated cylindrical pillow of about 12 inches in diameter and 50 inches in length which allow the user to lie on one side with one end of the pillow placed between the legs for better spinal alignment. Such pillows usually lack the firmness of support required for medical purposes, and provide limited support for only one side of the user's body.

Typical of prior art support pillows are those described in the following patents:

| U.S. Pat. No. | Patentee |
|---|---|
| 4,197,604 | Nakamura |
| 4,173,048 | Varaney |
| 4,236,264 | Britzman |
| 5,519,906 | Fanto-Chan |
| 682,871 | Hogan, et al. |
| D124,296 | Thompson |

Foreign Patents and Publications:

UK 838455

UK Appln. No. GB 2198341 A

All of the above pillows are relatively compact, usually less than 18 inches in length, and while they may be U-shaped to cradle the user's head and neck, they do not extend substantially further than the user's chest or shoulders and furnish little or no support to the back or the rest of the body.

SUMMARY OF THE INVENTION

It is, therefore, the principal object of the invention to provide an improved U-shaped body support pillow capable of giving relief from pain and discomfort to individuals who suffer from painful muscular and skeletal conditions.

Another object is to provide a support pillow which will allow pregnant women to sleep more comfortably, particularly in the final term of their pregnancy, and which will provide individuals with fibromyalgia with increased support in their cervical and thoracic spine areas, particularly when sleeping.

Since it is well known that individuals with low back pain may sleep more comfortably on their backs with knees elevated, or on their sides with a supportive cushion between their knees, it is an object of the invention to provide a support pillow which conveniently and easily provides this support.

An objective of particular interest to long term bedridden patients is to provide a pillow which offers full-body support in order to relieve pressure on particular portions of the body, such as the coccyx, where decubiti (bed sores) often form. By supporting the body and leaving such areas open to the air, healing is promoted and the user is restrained from rolling back onto the affected area.

A further object of the invention is to provide a pillow which will cradle the user's entire body and a detachable belt which wraps fully around the user and the pillow to pull the pillow into gentle but firm contact with the user's body.

A related object of the invention is to provide a pillow which will provide both comfort and restraint for geriatrics patients who are confined to geriatric chairs because of muscular weakness or stroke in which arm lateral support is provided by rotating an outward-extending portion of the pillow 90 degrees.

DESCRIPTION OF THE DRAWINGS

In the drawings,

FIG. 1 is an exploded view of the elements of a first embodiment of a pillow embodying the present invention showing their relationship prior to assembly;

FIG. 2 is a plan view of the fully assembled pillow of FIG. 1;

FIG. 3 is a side elevational view of the first embodiment of the present invention showing its size relationship to a typical user having a height "H";

FIG. 4 is a plan view of the pillow of the first embodiment shown with a detachable body-encircling securing strap;

FIG. 5 is a side elevational view of the pillow of FIG. 4;

FIG. 6 is a plan view of the pillow of FIG. 2 with its legs crossed and doubled to provide additional thickness for extra support;

FIG. 7 is a side elevational view of the pillow of FIG. 6 showing the crossed legs;

DESCRIPTION OF THE PREFERRED EMBODIMENT(S)

Figure 8:
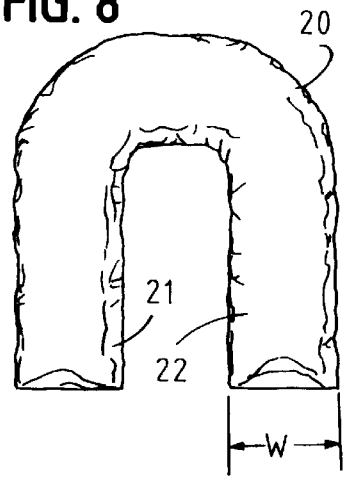
FIG. 8 is a plan view of a second embodiment of the present invention having shorter legs of width "W"

Referring to the drawings in greater detail, there is shown in FIG. 1 a first embodiment of a full body support pillow constructed according to the teachings of the invention.

As best shown in FIG. 2, the pillow 10 is constructed of a top fabric element 11, filler material 12 and bottom fabric element 13 sewn together at their periphery to form a generally U-shaped pillow having a total length "H" approximately equal to the height of a user, as shown in FIG. 3.

The top and bottom panels 11 and 13 are preferably made of cotton material, although they may be made of polyester or any other suitable, flexible material which is washable and can be sanitized for hospital use. The filler material 12 is preferably a resilient, compressible pillow filling such as down, feathers, polyester fiber insulating material (commonly known as "fiberfill") or other synthetic filler material. Polyester fiber insulating material has been found particularly suitable for use in the present invention because while soft to the touch, it maintains its shape and resiliency without bunching or separating into clumps which would adversely affect the pillow's overall firmness and uniformity.

The feature of the invention, the top and bottom portions 11, 13 are first sewn together around their periphery leaving the ends open, thereby defining a flexible fabric envelope having parallel depending leg sections 15 (FIG. 1). Closable zipper openings 16 may be provided at the terminus of each leg section 15 to allow stuffing 12 to be inserted after the top and bottom portions 11, 13 have been sewn together. After sewing together and stuffing, the result is an elongated hollow U-shaped body stuffed with resiliently deformable filler material.

As a feature of the invention, each of the legs 15 has a longitudinal dimension such that the total length of the U-shaped pillow is eventually equal to the height "H" of a person using it (FIG. 3).

As an additional feature of the invention, each of the legs 15 is not stuffed so tightly as to create a rigid balloon-like surface, but is instead or loosely stuffed such that when the pillow is placed on a horizontal surface, each of the legs 15 may be folded in a horizontal plane and one leg superimposed upon the other to form a double roughly doughnut-shaped structure having a doubled thickness at one end (FIGS. 6 and 7). In this configuration, a user may lie in a supine position (on his or her back) with additional pillow support under the user's knees to facilitate final alignment parallel to the horizontal surface and ease pressure on the coccyx and lower back muscles. Because the folded portions 15 16 are attached to and an integral part of the U-shaped pillow 10, they are prevented from sliding away from the user and add additional structure and firmness for the user's comfort.

As an additional feature of the invention, a detachable belt 17 may be provided which is preferably of a wide, soft fabric which is capable of wrapping entirely around the pillow with the user positioned inside the U-shaped hollow. By providing a detachable fastener means, such as hook and loop fastening strips 18, the pillow may be gently but firmly secured around the user to prevent movement away from the user when the user is, for example, asleep.

While hook and loop fastening means 18 is preferred, any manually operable attachment means can be used to secure the belt in place around the pillow and user, such as snap fasteners, string ties or a drawstring.

As a further feature of the preferred embodiment of the invention, the arcuate center section of the pillow 10 may be more firmly stuffed than the depending legs, with a density which provides greater support for the user's head, neck and shoulders. As best shown in FIG. 7, a manually detachable fastener means 19, preferably a strip of hook and loop fasteners, may be applied to the opposing faces of the depending legs 15 to more securely hold the legs in folded position whereby the additional thickness in one end of the doughnut-shaped that results may be more easily retained (FIG. 7).

In a second preferred embodiment 20 of the invention, best shown in FIGS. 8–11, the depending legs 21, 22 are shorter, making the support pillow more easily transferable to a chair or an automobile seat. In this embodiment, each of the two depending legs 21, 22 has a central axis parallel to the central axis of the other and about which the end of the leg may be rotated up to 90 degrees. The legs are created with a width "W" which is at least 50 percent wider than the thickness "T" (FIG. 9) of the leg when stuffed.

Figure 9:
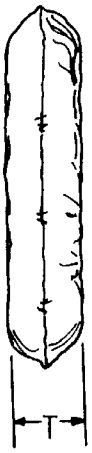
FIG. 9 is a side elevational view of the second embodiment shown in FIG. 8 having a thickness "T"
Figure 10:
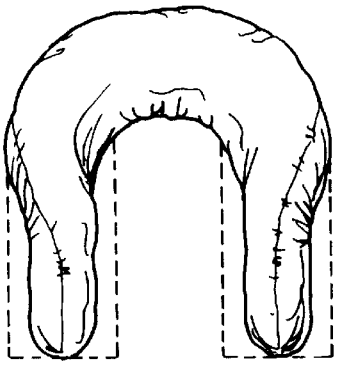
FIG. 10 is the second embodiment of FIGS. 8 and 9 showing its depending portions rotated 90 degrees to provide additional thickness for the user's elbows and arms.
Figure 11:
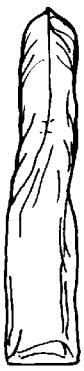
FIG. 11 is a side elevational view showing the pillow of FIG. 10 with its depending portions rotated to provide additional elevation.

This feature provides a wide base of support for the user's arms when the leg is in a flat horizontal position, as shown in FIGS. 8 and 9. If, however, the user wishes to provide a raised support for the arms, the terminal portions of the arms 21, 22 may be rotated up to 90 degrees, as shown in FIGS. 10 and 11, to make a relatively thicker support so that the user's arms may be positioned at a higher level. This feature is useful to provide variations in position to improve circulation and prevent joint stiffness.

A principal advantage of the support pillow for use in automobiles is that automobile seats vary greatly from one vehicle to the next, causing discomfort for many occupants. The support pillow of the present invention provides support in places where the automobile seat generally does not, such as behind the neck, around the shoulders and at the sides, in addition to providing arm support for the forearms similar but superior to that provided by the conventional arm rest. In addition, the adjustable feature of the present invention allows selective position of the arms at different heights.

Figure 12:
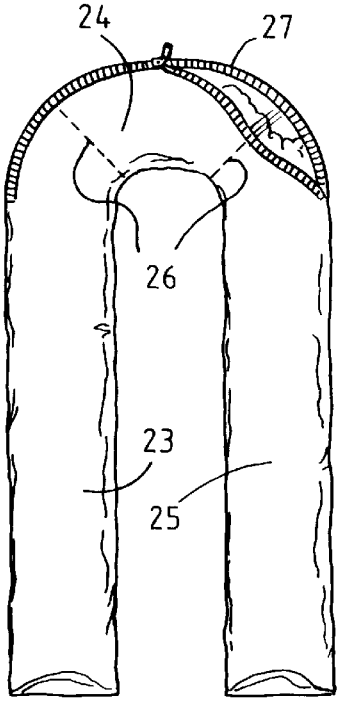
FIG. 12 is a plan view of a third embodiment of the invention in which the interior is divided by baffles into three separate compartments accessible through a single zipper opening.
Figure 13:
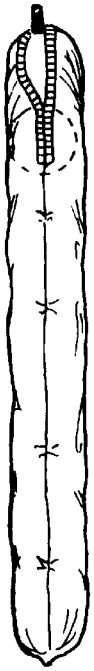
FIG. 13 is a side elevational view of the pillow of FIG. 12.

A third preferred embodiment of the invention is shown in FIGS. 12 and 13, where the pillow is divided into three separately stuffable compartments 23, 24, 25 by sewn-in baffles 26. The three compartments are accessible through a single zipper opening 27 which substantially spans the arcuate center section of the pillow, offering a single opening through which stuffing can easily be inserted or removed by the user to accommodate his or her personal needs and preferences.

I claim as my invention:

1. A supportive full-body pillow comprising a flexible fabric envelope having a center section and depending parallel first and second leg sections each having an upper and a lower end, said leg sections being joined at their upper ends to said center section to define an elongated hollow U-shaped body, said body being stuffed with a resiliently deformable filler material, wherein the center section is stuffed more firmly than the depending leg sections, and characterized by:

said leg sections being loosely stuffed whereby when the pillow is placed on a horizontal surface, the lower ends of said leg sections are selectively foldable in a lateral direction whereby a folded lower half of the first leg section may be placed in superimposed position upon a folded lower half of the second leg section to form an overlapping 360 degree enclosure; and attachment means for manually and releasably attaching said folded lower half of said first leg section to said folded lower half of said second leg section to retain said folded lower halves in said superimposed position, whereby the combined folded lower halves may provide a double pillow under the knees of a supine user.

2. The supportive pillow of claim 1 wherein the attachment means comprise a hook-and-loop fastener strip.

3. The supportive pillow of claim 1 further including means for releasably and adjustably encircling the leg sections of the pillow with a supine user lying therebetween, thereby providing supplemental support, both anteriorly and posteriorly, for said user.

4. The supportive pillow of claim 1 wherein the supportive pillow is divided into separately stuffable contiguous compartments by baffles, and having a zipper opening for providing access to said compartments.

5. The supportive pillow of claim 4 wherein the zipper opening spans all of the separately stuffable compartments.

* * * * *